US006322463B1

(12) United States Patent
Forsythe et al.

(10) Patent No.: US 6,322,463 B1
(45) Date of Patent: Nov. 27, 2001

(54) METHOD OF TUNING A BAT AND A TUNED BAT

(75) Inventors: Paul D. Forsythe, Phoenix, AZ (US); Douglas M. Hoon, Guilford, CT (US)

(73) Assignee: Composites Design Services, LLC, Phoenix, AZ (US)

( * ) Notice: Subject to any disclaimer, the term of this patent is extended or adjusted under 35 U.S.C. 154(b) by 0 days.

(21) Appl. No.: 09/348,558

(22) Filed: Jul. 7, 1999

(51) Int. Cl.[7] ..... A63B 59/06
(52) U.S. Cl. ..... 473/566; 473/566; 473/520
(58) Field of Search ..... 473/519, 520, 473/564–568

(56) References Cited

U.S. PATENT DOCUMENTS

| | | | | |
|---|---|---|---|---|
| 4,928,965 | * | 5/1990 | Yamaguchi et al. | 473/520 |
| 5,114,144 | | 5/1992 | Baum . | |
| 5,219,164 | | 6/1993 | Peng . | |
| 5,303,917 | | 4/1994 | Uke . | |
| 5,364,095 | | 11/1994 | Easton et al. . | |
| 5,415,398 | | 5/1995 | Eggiman . | |
| 5,458,330 | | 10/1995 | Baum . | |
| 5,460,369 | | 10/1995 | Baum . | |
| 5,511,777 | | 4/1996 | McNeely . | |
| 5,533,723 | | 7/1996 | Baum . | |
| 5,624,115 | | 4/1997 | Baum . | |
| 5,676,610 | | 10/1997 | Bhatt et al. . | |
| 5,722,908 | | 3/1998 | Feeney et al. . | |
| 6,042,493 | * | 3/2000 | Chauvin et al. | 473/566 |

FOREIGN PATENT DOCUMENTS

10248978 * 9/1998 (JP) .

OTHER PUBLICATIONS

Adair, Robert Kemp, *The Physics of Baseball,* Harper & Row Publishers, New York, 1990, Chapters 4–5, pp. 44–106.

* cited by examiner

*Primary Examiner*—Mark S. Graham
(74) *Attorney, Agent, or Firm*—Schmeiser, Olsen & Watts

(57) ABSTRACT

A method of tuning a bat includes estimating a ball-bat interaction time, Ti, of an impact between a ball and the bat and tuning at least one desired mode of vibration in the bat produced by the impact. The desired mode of vibration is tuned by selecting properties of the bat so that the desired mode of vibration has a period approximately equal to 4/3Ti. When a mode of vibration is so tuned, the energy the vibration transfers to a batted ball is optimized. A tuned bat has one or more of the desired modes that is approximately equal to 4/3Ti, giving the bat a desirable bat performance factor and a desirable level of durability. Typically, the first hoop mode of vibration is given first priority during tuning of the bat. However, other modes of vibration, such as an axial bending mode of vibration may also be tuned.

15 Claims, 4 Drawing Sheets

METHOD OF TUNING A BAT AND A TUNED BAT

BACKGROUND OF THE INVENTION

1. Technical Field

This invention generally relates to bats, such as baseball and softball bats, and more specifically relates to a method of tuning such bats for optimum performance and to bats that are tuned.

2. Background Art

Bats, such as baseball and softball bats, are well known. Many bat manufacturers have attempted to produce more lively bats (bats that would allow players to hit the ball with greater velocity). Such attempts have included the use of composite materials in the structure of tubular bats. Manufacturers thought that the composites would make the bats stiffer and thereby improve their performance. However, stiffer composite bats have generally been less lively than bats produced from more conventional materials, such as aluminum.

Others have attempted to manufacture more lively bats by altering the dimensions of bats made from aluminum, titanium, and composite or combinations thereof. These alterations have generally been done by trial and error, wherein a manufacturer alters the bat dimensions, manufactures a bat, tests the bat's performance to determine whether it is lively, and begins the process again until a more lively bat is produced. These trial-and-error alterations are expensive and time consuming, and moreover, they are not guaranteed to produce advantageous results. However, such alterations have produced some success. For example, it has been found that titanium and aluminum bats having thin-walled barrels generally perform better than such bats having thick-walled barrels. Even this advance has been limited because bats having thin-walled barrels are generally less durable than bats having thick-walled barrels. Therefore, bat manufacturers have been caught in the difficult position of choosing between greater performance and greater durability.

Another example of an attempt at trial-and-error alterations is U.S. Pat. No. 5,624,115 to Baum, issued Apr. 29, 1997 (the '115 patent). The '115 patent discloses a composite bat having a central cavity within the barrel. The '115 patent also discloses that the nature of the composite layers that form the barrel may be adjusted so that, upon impact the barrel undergoes localized deformation and hoop deformation. The 115' patent also states that the cavity increases the hoop spring and decreases the local deformation, and that the size and shape of the cavity may be designed to maximize energy transfer to the ball. However, the '115 patent does not disclose how the energy transfer to a batted ball can be optimized in different bats, and, therefore, its disclosure does not obviate the need for trial-and-error alterations.

The governing authorities in some softball leagues and tournaments have increased the difficulty of the manufacturers' position. These authorities have banned bats that are too lively because of injuries to infielders produced by high-velocity batted balls. Accordingly, these authorities require that all bats be tested before players use them in official games, thereby assuring that the bats are not too lively. The required tests yield a bat performance factor (BPF), wherein a higher number corresponds to a bat having a greater ability to produce high velocities in batted balls. Typically, these authorities require that the BPF of a bat be no greater than 1.20. Thus, it is now desirable in many instances to make a bat that is lively, but not too lively.

Trial-and-error alterations are even more time-consuming and expensive to manufacturers trying to achieve optimum results without producing a bat that is too lively.

DISCLOSURE OF INVENTION

Accordingly, there is a need for an improved method of selecting the properties of a bat that will optimize the performance of the bat without significant trial-and-error alterations, and an optimized bat produced by the method that has optimum performance and optimum durability. The present invention fills this need.

The invention includes a method of tuning a bat. The method includes estimating a ball-bat interaction time, Ti, of an impact between a ball and the bat, and tuning at least one desired mode of vibration in the bat produced by the impact. The desired mode of vibration is tuned by selecting a factor and selecting properties of the bat so that a desired mode of vibration has a period approximately equal to Ti multiplied by the factor. In one embodiment the factor is 4/3 so that the period is approximately equal to 4/3Ti.

Regardless of how a bat is tuned, the bat will store energy, and it will release that energy during subsequent vibrations. However, when a mode of vibration is tuned so that a desired mode of vibration has a period approximately equal to 4/3Ti, the desired mode of vibration will transfer more of the released energy to the batted ball than if the mode of vibration had some other period. Thus, the desired mode of vibration will release energy more constructively. Furthermore, by tuning the bat in this manner, the cost and time involved in optimizing the performance of a bat is decreased significantly, and a tuned bat, wherein one or more of the select modes is approximately equal to 4/3Ti has a desirable BPF. The method of the present invention also allows the wall thickness of a tubular bat to be maximized for a particular BPF, thereby maximizing durability of the bat.

Properties that may be selected in tuning the bat include modulus of elasticity, material density, and wall thickness for tubular bats. The modulus of elasticity may be selected by selecting the material of the bat, such as aluminum or titanium. In a composite bat, this may be done by selecting the fiber type or the angle of the fibers with respect to a longitudinal axis of the bat. For example, fibers may be selected that have from about 33 million psi modulus to about 120 million psi modulus. The density may be selected by selecting the material type or, in a composite bat, by selecting the volumetric fiber density. Moreover, the weight of the tip cap and the butt cap can be selected, and will affect the period of axial bending modes of vibration.

Typically, the selection of wall thickness, the fiber type, and the fiber angle will have the greatest impact on the periods of vibration because they can vary greatly, and they affect the overall stiffness of the bat. Of these, wall thickness typically can have the greatest effect. Although the density will affect the periods of vibration, it cannot be varied greatly after a general type of material has been chosen. For example, once composite materials are selected, the density cannot be varied greatly because the density between different composites does not vary greatly.

Typically, the first hoop mode of vibration will impart the most energy to a batted ball, so its optimization is given first priority during tuning of the bat. However, other modes of vibration, such as an axial bending mode of vibration may also be tuned to have a period approximately equal to 4/3Ti. This is particularly true in composite bats where selecting the fiber angles can yield a different modulus of elasticity in the hoop direction than in the direction of the longitudinal axis of the bat. Thus, a tuned bat may have a tuned mode from each of multiple types of vibrations, such as axial and hoop vibration.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements.

MODES FOR CARRYING OUT THE INVENTION

Figure 1:
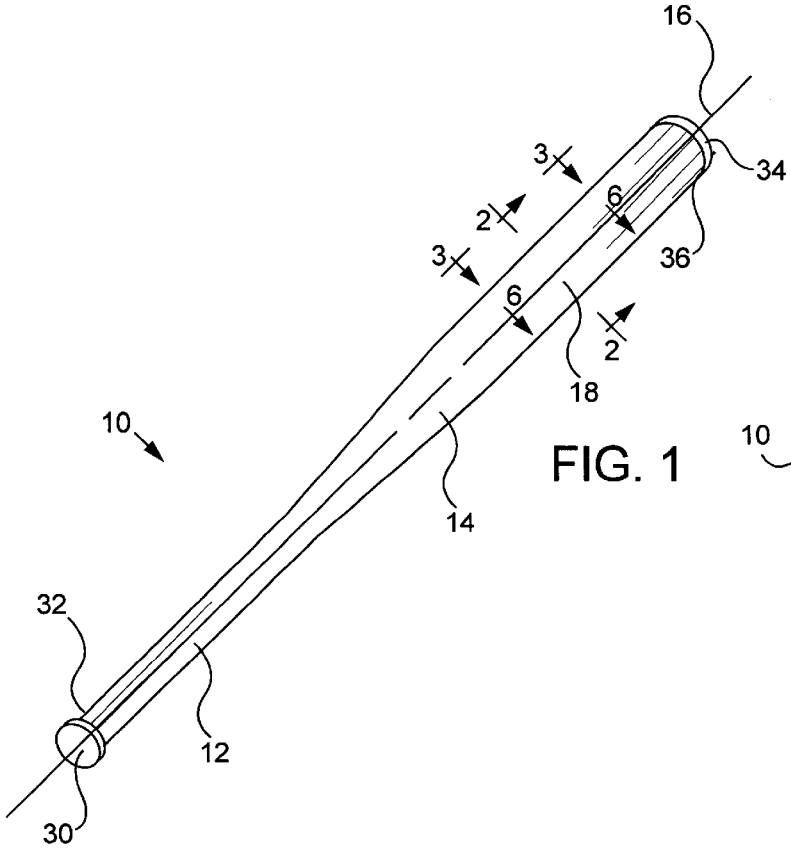
FIG. 1 is a perspective view of a bat according to the present invention.

Referring to FIG. 1, a tubular baseball or softball bat 10 includes a handle 12, an intermediate tapering portion 14 extending from handle 12 along a longitudinal axis 16, and a barrel 18, having a diameter that is larger than the diameter of handle 12, extending from tapering portion 14 along longitudinal axis 16 distal from handle 12. Bat 10 further includes a butt cap 30 that forms a closure of an open terminus 32 of handle 12 distal from tapering portion 14. Butt cap 30 is coaxial with handle 12 and extends radially outwardly from terminus 32 of handle 12. Bat 10 also includes a tip cap 34 that forms a closure of an open terminus 36 of barrel 18 distal from tapering portion 14. Tip cap 34 is coaxial with barrel 18 and has a diameter approximately equal to that of barrel 18.

Figure 2:
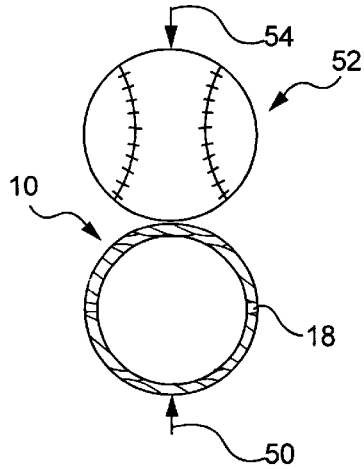
FIG. 2 is an enlarged cross sectional view of the bat of FIG. 1, taken along line 2—2 of FIG. 1, as the bat is coming into contact with a ball.
Figure 5:
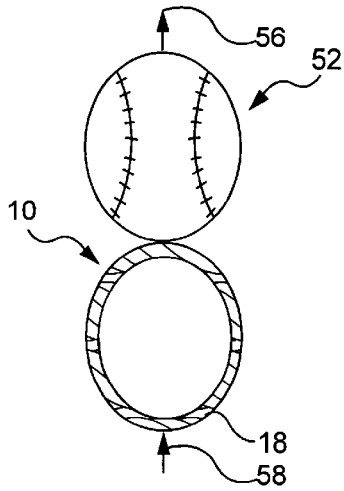
FIG. 5 is a view, similar to FIG. 2, of the bat of FIG. 1 as it is fully extended and the ball is leaving the bat.
Figure 6:
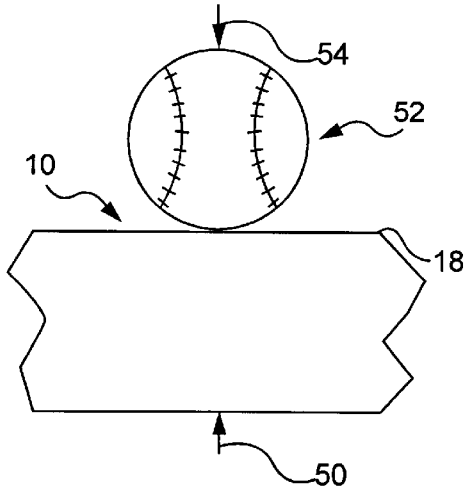
FIG. 6 is an enlarged view of the bat of FIG. 1, taken along line 3—3 of FIG. 1, as the bat is coming into contact with a ball.

In use, a user grips handle 12 and swings bat 10 so that barrel 18 has an initial velocity 50 (see FIG. 2). Referring now to FIGS. 2-5, barrel 18 then strikes a ball 52, having an initial velocity 54 (see FIG. 2). Upon impact, ball 52 and barrel 18 remain in contact during a ball-bat interaction time (Ti). During Ti, bat 10 transfers some of its kinetic energy to ball 52, giving ball 52 a final velocity 56 upon leaving barrel 18 (see FIG. 5). Final velocity 58 of barrel 18, shown in FIG. 5, is less than initial velocity 50 of barrel 18 because of the transferred kinetic energy.

Figure 3:
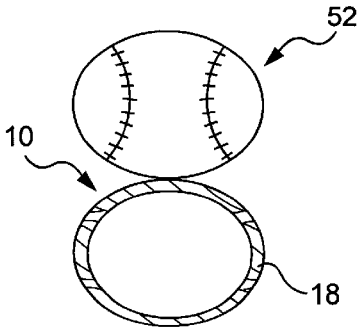
FIG. 3 is a view, similar to FIG. 2, of the bat of FIG. 1 as it is filly compressed and in contact with a ball.
Figure 4:
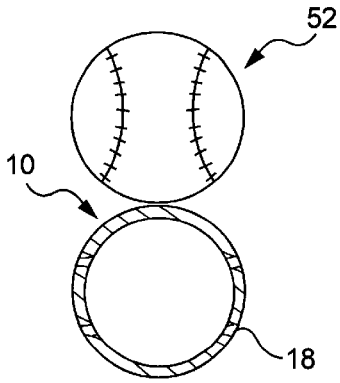
FIG. 4 is a view, similar to FIG. 2, of the bat of FIG. 1 as it returns to its original cross sectional shape.

The impact between ball 52 and barrel 18 causes barrel 18 to undergo hoop deformation, wherein the initially round cross-section of barrel 18 deforms into an oval, as shown in FIG. 3. In its deformed shape, the barrel has energy stored in it. Barrel 18 continues to vibrate between the deformed oval shown in FIG. 3, wherein it is fully compressed (it has undergone one-fourth of a period of vibration), and the deformed oval shown in FIG. 5, wherein it is fully extended (it has undergone three-fourths of a period of vibration). Such vibration is hoop vibration. As with other vibrations resulting from an impact, hoop vibration includes modes of vibration, or oscillation modes, with each mode having a period of vibration determined by the properties of the vibrating object, in this case bat 10. In a full period of the first hoop mode of vibration resulting from an impact with ball 52, barrel 18 begins with a circular cross section (see FIG. 2), becomes fully compressed (see FIG. 3), returns to its original circular cross section (see FIG. 4), becomes fully extended (see FIG. 5), and returns again to the circular cross section (see FIG. 2).

Figure 7:
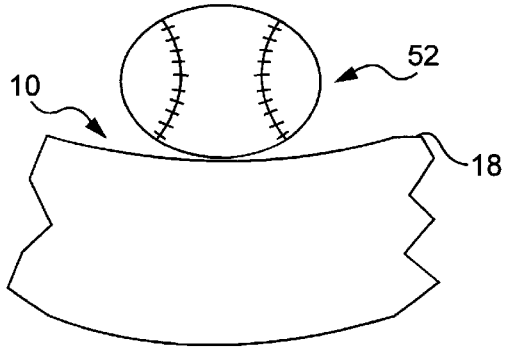
FIG. 7 is a view, similar to FIG. 6, of the bat of FIG. 1 as it is fully compressed and in contact with a ball.
Figure 8:
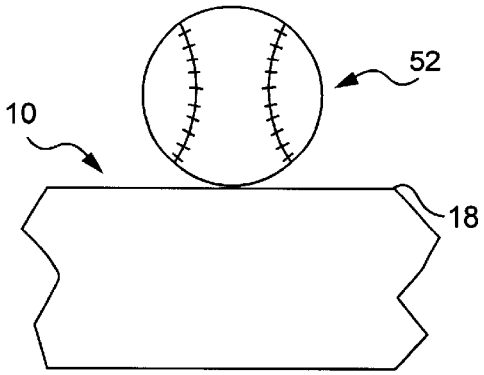
FIG. 8 is a view, similar to FIG. 6, of the bat of FIG. 1 as it returns to its original shape.
Figure 9:
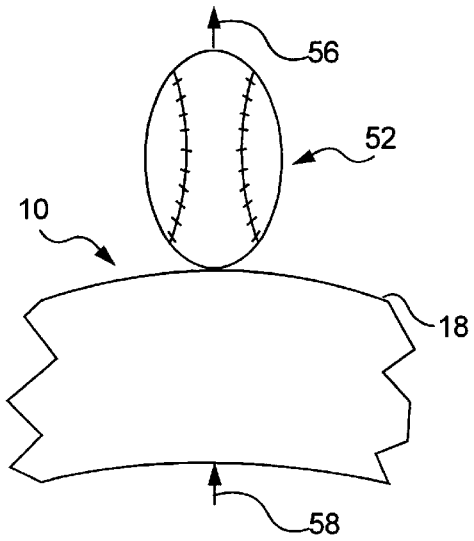
FIG. 9 is a view, similar to FIG. 6, of the bat of FIG. 1 as it is fully extended and the ball is leaving the bat.

Referring now to FIGS. 6–9, an impact between ball 52 and barrel 18 causes barrel 18 to undergo axial bending in addition to the hoop deformation described above. In axial bending, the initially straight barrel 18 forms an arc, as shown in FIG. 7. The barrel has energy stored within it when it forms an arc. Barrel 18 continues to vibrate between the arc shown in FIG. 7, wherein it is fully compressed (it has undergone one-fourth of a period of vibration), and the arc shown in FIG. 9, wherein it is fully extended (it has undergone three-fourths of a period of vibration). Such vibration is axial bending vibration. Axial bending vibration also includes modes of vibration, with each mode having a period of vibration determined by the properties of the vibrating object, in this case bat 10. In a full period of axial bending vibration resulting from impact with ball 52, barrel 18 begins as a straight tube (see FIG. 6), becomes fully compressed (see FIG. 7), returns to its straight shape (see FIG. 8), becomes fully extended (see FIG. 9), and returns again to its straight shape (see FIG. 6).

Hoop vibration and axial bending vibration both transfer energy to ball 52 during Ti. Thus, if the period of each type of vibration is timed with Ti, the energy transfer of that vibration may be optimized. A bat 10 tuned according to the present invention has a hoop mode of vibration with a period that is approximately equal to Ti multiplied by a factor that will provide a desired level of energy transfer. The factor should be from about 1 to about 3. In a preferred embodiment, the factor is from about 4/3 to about 2, with 4/3 providing particularly good results. Thus, to maximize energy transfer from the bat 10 to a batted ball, the bat 10 is preferably tuned so that the mode of vibration having the most energy is approximately equal to 4/3Ti. Accordingly, it is preferable for the first hoop mode of vibration (the mode of hoop vibration having the largest amplitude) to have a period approximately equal to 4/3Ti.

Thus, during the interaction of bat 10 with ball 52, the hoop vibration will fully compress (see FIG. 3), will return to approximately its original circular cross-section (see FIG. 4), and will fully extend (see FIG. 5). Preferably, one of the axial bending modes of vibration also has a period approximately equal to 4/3Ti so that energy transfer from axial bending will also be optimized. Initial testing indicates that having the third or fourth axial bending mode of vibration approximately equal to 4/3Ti produces advantageous results. However, another axial bending mode of vibration may produce results that are even more advantageous.

Impact may also produce other types of vibration, such as torsional vibration and longitudinal shock waves. The method of the present invention may also be used to optimize the energy transfer from such other types of vibrations.

Figure 10:
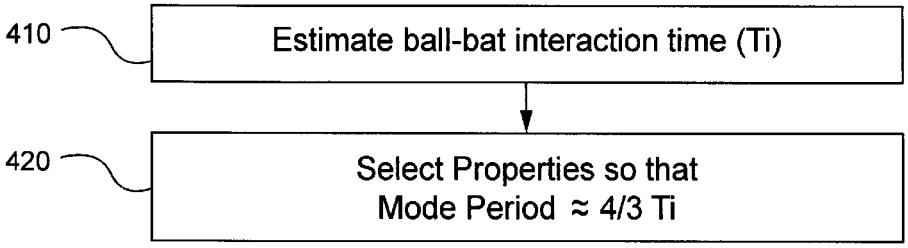
FIG. 10 is a flowchart depicting a method of tuning a bat according to the present invention.

Referring now to FIG. 10, a method of tuning a bat generally includes estimating Ti 410 and selecting properties of the bat so that the desired mode periods approximately equal Ti multiplied by a factor. A preferred embodiment includes selecting properties of the bat so that the desired mode periods approximately equal 4/3Ti 420. Ti varies based on, among other factors, the hardness of the ball, the resiliency of the bat, the initial velocity of the ball, and the initial velocity of the barrel. Robert Kemp Adair, in his book The Physics of Baseball (1990), used equations to estimate that Ti generally falls within the range of from about 0.4 to about 1.0 milliseconds. Thus, the desired range for three-fourths the period of a vibration when the maximum BPF is desired is generally from about 0.4 to about 1.0 milliseconds, with 0.7 milliseconds providing particularly good results.

Pursuant to the development of the present invention, this range for Ti has been verified by testing many bats and determining the correlation between the periods of vibration for a bat and the bat's BPF. Such tests and correlations revealed that, with all else being equal, bats having a first hoop mode of vibration with a higher amplitude also had a higher BPF. For example, a bat with a first hoop mode of vibration period of 0.8 milliseconds (¾ the period equals 0.6 milliseconds) had a BPF of about 1.35, while a bat with a first hoop mode of vibration period of 0.45 milliseconds (¾ the period equals 0.34 milliseconds) had a BPF of about 1.15. However, the BPF of a bat may also be affected by factors other than the periods of vibration. Furthermore, the magnitude of the period of a bat is limited by its durability. A thinner-walled bat will have a higher period of vibration, but it will also be less durable. Typically, a bat with a first hoop mode of vibration period above 0.8 milliseconds will not be durable because the barrel wall will be too thin. Accordingly, correlations between the BPF and the periods of vibration have not been tested with periods above 0.8 milliseconds. However, those of skill in the art will recognize that the present invention is not limited to any particular period, or particular value for Ti.

The properties that have the greatest effect on the magnitude of periods of vibration of tubular bats include the thickness of the wall, especially the wall thickness of the barrel (a thicker wall reduces the period), the density of the material in the bat (greater density increases the period), and the material's modulus of elasticity (greater modulus reduces the period). Other properties, such as the weight of the butt cap, the weight of the tip cap, and the length of the bat affect the periods of the axial bending modes of vibration, but do not significantly affect the periods of the hoop modes of vibration. The aforementioned properties can be selected so that the period of vibration of a desired type and mode is approximately equal to 4/3Ti.

The method will now be described with more particularity, with reference to a tubular bat, and more specifically with reference to a tubular composite bat. The desired properties for tubular bats manufactured using non-composite materials may be achieved by selecting a wall thickness and selecting a material, such as a particular aluminum or titanium alloy, having the desired modulus and density.

Figure 11:
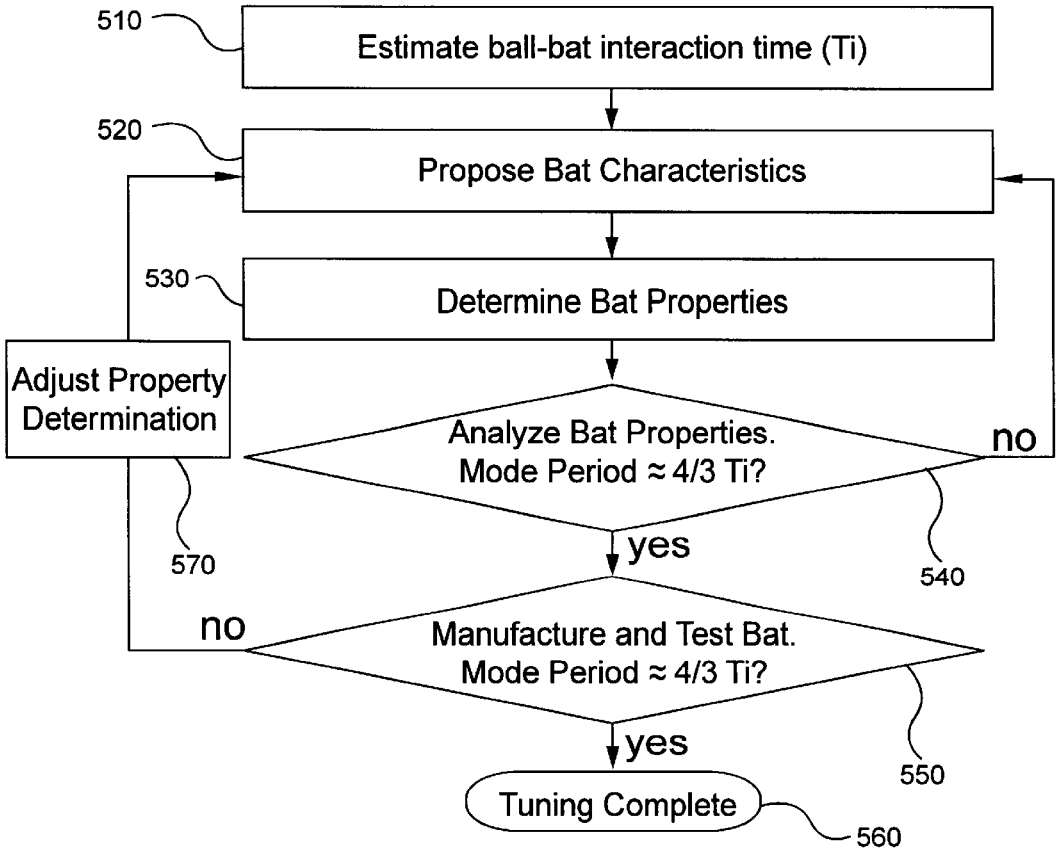
FIG. 11 is flowchart depicting the method of FIG. 10 in more detail.

Referring to FIG. 11, the method of tuning a bat includes estimating Ti 510 (410 in FIG. 10). Selecting material properties of the bat (420 in FIG. 10) preferably includes proposing bat characteristics 520, determining bat properties from the proposed characteristics 530, analyzing the bat properties to determine whether the desired mode period is approximately equal to 4/3Ti 540, manufacturing and testing the bat to determine whether the mode period is approximately equal to 4/3Ti 550, and adjusting the property determination 570.

More specifically, proposing bat characteristics preferably includes proposing a wall thickness for a tubular bat. Typically, it will also include proposing characteristics that will affect the density of the bat, such as the types of materials used and, in composite bats, the volumetric ratio of fibers to matrix. It will also typically include proposing characteristics that will affect the modulus of elasticity of the bat, such as the type of materials used and, in composite bats, the direction of the fibers with respect to the longitudinal axis of the bat. Depending on the orientation of the fibers of a composite bat, the modulus of elasticity may be anisotropic. For example, the fibers may be oriented such that the material has a larger modulus in the hoop direction than in the longitudinal direction. Other proposed characteristics may include the length of the bat and the weight of the tip cap and the butt cap. In proposing characteristics, thought should be given to whether the proposed characteristics can be manufactured effectively.

Determining bat properties 530 includes applying known relationships between proposed bat characteristics and resulting bat properties so that the proposed characteristics, such as material types, fiber angles and fiber density, reveal properties, such as modulus of elasticity and material density. The relationships are preferably revealed by laminate analysis using a computer, and inputting the known properties of the materials, such as the density and modulus of the matrix and the fibers, and inputting the fiber angles, the volumetric fiber density, and the number of layers into the computer. Laminate analysis is well known in the art and may be done using well-known equations programmed into a computer.

Analyzing bat properties 540 includes analyzing the determined properties to yield periods of several modes of different types of vibrations. Preferably, the analysis includes entering the bat properties into a finite element modeling system, such as the system sold under the name NASTRAN, available from The MacNeal Schwendler Corporation located in Los Angeles, Calif., and performing a normal modes analysis on the bat properties using the modeling system. Finite element modeling systems are well known to those skilled in the art. The analysis should at least yield the period of the first hoop mode of vibration. The values received from the modeling system should be checked to determine whether the first hoop mode of vibration is approximately equal to 4/3Ti. Moreover, if tuning another type of vibration, such as one of the axial bending modes of vibration, is desired, the period of that mode should be checked to determine whether it is approximately equal to 4/3Ti.

It is possible to simultaneously tune more than one type of vibration using composite materials because changing the fiber directions will yield a different modulus of elasticity for each of the hoop and longitudinal directions. Such a differential in the modulus between the axial (parallel to the longitudinal axis of the bat) and hoop (circumferentially around the bat and perpendicular to the longitudinal axis of the bat) directions allows both the hoop and axial bending vibrations to be tuned in the same bat. For example, the fiber angles may be oriented such that the first hoop mode of vibration is tuned, and at the same time they may be oriented such that an axial bending mode of vibration is tuned, even if the tuning for each of these modes requires a different modulus of elasticity. Generally, the outermost layers and the innermost layers will have the greatest effect on the periods of hoop vibration, but the intermediate layers can significantly effect the axial bending modes of vibration.

If the period for each desired mode is not approximately equal to 4/3Ti, then new bat characteristics should be proposed 520, bat properties should be determined from those characteristics 530, and the new properties should be analyzed to determine whether each desired mode period is approximately equal to 4/3Ti 540. This should be repeated until the analysis indicates that each desired mode period is approximately equal to 4/3Ti.

At least one bat having the proposed characteristics may then be manufactured and tested 550 to see if the actual desired mode periods are approximately equal to 4/3Ti. The bat may be manufactured according to known methods. In embodiments wherein the bat is a composite bat, the bat may be manufactured using a filament winding machine of a type that is well known in the art. For example, a 3-axis filament winding machine such as the one available from ENTEC, located in Salt Lake City, Utah. When using a filament winding machine, it is sometimes advantageous to include a braided layer in the barrel of the bat that does not extend to the handle of the bat. Such a layer will allow the requisite thickness for the barrel, but will prevent unnecessary weight from being added to the handle.

The layers preferably include glass fibers, and preferably the glass fibers have a modulus of about 6 million to 13 million psi, and have high strength and toughness. In a preferred embodiment the fibers on the first (inner-most) layer and the last (outermost) layer are glass fibers. Preferably, the glass fibers have a modulus of elasticity that is about 13 million psi at about 73 degrees Fahrenheit, such as the glass fibers sold under the trademark S-2 by Advanced Glass Fiber Yarns, Inc. located in Aiken, S.C., because of the toughness and low modulus of such glass fibers. The glass may also be an E-glass. However, the remaining layers may use graphite fibers for increased stiffness. Preferably, the graphite fibers are intermediate modulus graphite fibers having a modulus of about 33 million psi.

After the fibers have been wound using a filament winding machine, a matrix is injected within the web of fibers, such that the matrix will cure and will then support the fibers. Alternatively, pre-impregnated fibers may be used with the filament winding machine so that injection will not be necessary, or the bat may be manufactured using table wrapping (also known as table rolling). Preferably, the matrix is an epoxy resin because epoxy resin has good mechanical properties, for example it is strong in inter-laminar shear. However, it may be desirable to use another type of matrix. For example, a vinyl ester may be used because it cures faster than epoxy resins, so its use might increase production.

One method of testing the bat includes attaching accelerometers to the bat. Accelerometers and methods of using them are well known to those of skill in the art. The bat may then be supported in a way that will reduce external interference with the vibration of the bat. Preferably, the bat is suspended using elastomeric cords. The bat is then struck, and the output of the accelerometers is recorded to reveal the periods of the modes of vibration of the bat. The periods of the desired modes of vibration should be checked to see if they are approximately equal to 4/3Ti. The bat may also be tested by doing a BPF test, which is known to those of skill in the art.

If the period for each desired mode is not approximately equal to 4/3Ti, then the relationships used to determine the properties of the bat should be adjusted 570 to reflect the results of the test. Then, new bat characteristics should be proposed 520, bat properties should be determined from those characteristics 530, and the new properties should be analyzed to determine whether each desired mode period is approximately equal to 4/3Ti 540. This process should be repeated until the analysis indicates that each desired mode period is approximately equal to 4/3Ti. At least one bat having the new proposed characteristics should then be manufactured and tested 550 to see if the actual desired mode periods are approximately equal to 4/3Ti. This should preferably be repeated until a bat is tested, and each desired mode has a period approximately equal to 4/3Ti, at which time tuning is complete 560.

Because determining bat properties 530 and analyzing bat properties 540 are both done without actually manufacturing and testing a bat, and because the desired period for the tuned modes is known, the time and money required to optimize the performance of a bat is significantly decreased by the method depicted in FIG. 11. Moreover, the method may be used to attain a desired BPF and maximize durability by achieving periods of vibration that yield the desired frequency, but that allow maximum wall thickness.

Figure 12:
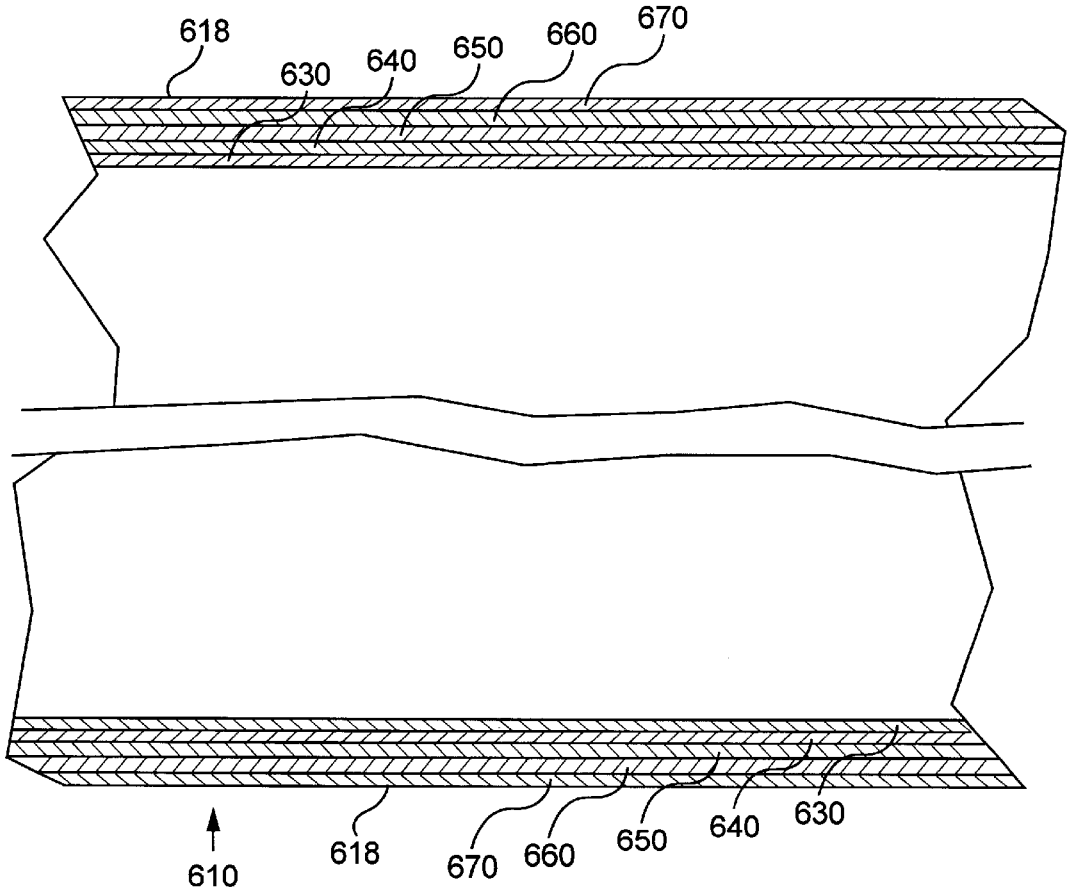
FIG. 12 is an enlarged sectional view taken along line 6—6 of FIG. 1.

Referring now to FIG. 12, a composite bat 610 includes a barrel 618 having multiple tubular composite layers. Bat 610 has been tuned, such that the periods of the first hoop mode of vibration and the third or fourth axial bending mode of vibration are approximately equal to 4/3Ti. The barrel 618 includes a first composite layer 630, a second composite layer 640, a third composite layer 650, a fourth composite layer 660, and a fifth composite layer 670. Bat 610 has a handle with a longitudinal length of 12 inches and an outside diameter of 0.817 inch; a barrel distal the handle that has a longitudinal length of 12 inches and an outside diameter of 2.250 inches; and a tapering portion intermediate the handle and the barrel that has a longitudinal length of 10 inches.

Design modifications to bat 610 have yielded six options (each corresponding to a column in the table below) that include the fiber angle (degrees relative to the longitudinal axis of the bat), the fiber type, the number of plies, and the thickness (inches) of each of the five layers. In each option, the weight of the tip cap is about 60 grams, and the weight of the butt cap is from about 20 grams to about 30 grams. These designs and the resulting predicted frequencies from analyzing the bat properties (the frequencies being equal to 1/period) are set forth in the table below. It is desirable for the frequencies to be from about 1200 Hz to about 2200 Hz. Frequencies of from about 1550 Hz to about 1650 Hz are desirable to produce a bat performance factor of about 1.20. However, frequencies of about 1250 Hz may be desirable to maximize a bat's BPF.

| Option | 1 | 2 | 3 | 4 | 5 | 6 |
|---|---|---|---|---|---|---|
| Layer 1 | | | | | | |
| Fiber Angle | 25 | 25 | 25 | 25 | 25 | 25 |
| Fiber Type | Glass | Glass | Glass | Glass | Glass | Glass |
| No. Plies | 2 | 2 | 2 | 2 | 2 | 2 |
| Thickness | 0.02 | 0.02 | 0.02 | 0.02 | 0.02 | 0.02 |
| Layer 2 | | | | | | |
| Fiber Angle | 30 | 46 | 35 | 35 | 46 | 46 |
| Fiber Type | Glass | Glass | Glass | Glass | Glass | Glass |

-continued

| Option | 1 | 2 | 3 | 4 | 5 | 6 |
|---|---|---|---|---|---|---|
| | Braid | Braid | Braid | Braid | Braid | Braid |
| No. Plies | 2 | 2 | 2 | 2 | 2 | 2 |
| Thickness | 0.03 | 0.03 | 0.03 | 0.03 | 0.03 | 0.03 |
| Layer 3 | | | | | | |
| Fiber Angle | 15 | 15 | 15 | 10 | 15 | 15 |
| Fiber Type | Graphite | Graphite | Graphite | Graphite | Graphite | Graphite |
| No. Plies | 1 | 1 | 1 | 1 | 1 | 1 |
| Thickness | 0.026 | 0.026 | 0.026 | 0.026 | 0.026 | 0.026 |
| Layer 4 | | | | | | |
| Fiber Angle | 30 | 38 | 38 | 38 | 50 | 50 |
| Fiber Type | Glass | Glass | Glass | Glass | Glass | Glass |
| | Braid | Braid | Braid | Braid | Braid | Braid |
| No. Plies | 2 | 2 | 2 | 2 | 2 | 2 |
| Thickness | 0.03 | 0.03 | 0.03 | 0.03 | 0.03 | 0.03 |
| Layer 5 | | | | | | |
| Fiber Angle | 25 | 25 | 25 | 25 | 25 | 25 |
| Fiber Type | Glass | Glass | Glass | Glass | Glass | Glass |
| No. Plies | 2 | 2 | 2 | 2 | 2 | 2 |
| Thickness | 0.02 | 0.02 | 0.02 | 0.02 | 0.02 | 0.02 |
| Predicted Frequencies for Selected Modes (Hz) | | | | | | |
| 1st Hoop | 1416 | 1501 | 1457 | 1458 | 1608 | 1718 |
| 3rd Axial | 1064 | 1035 | 1046 | 1059 | 1021 | 954 |
| 4th Axial | 1688 | 1661 | 1672 | 1681 | 1646 | 1533 |

The present invention is not limited to a bat having the characteristics set forth in the preceding table, but those characteristics will produce a working bat having the advantages of the present invention.

While the invention has been particularly shown and described with reference to preferred embodiments thereof, it will be understood by those skilled in the art that various changes in form and details may be made therein without departing from the spirit and scope of the invention. For example, it will be understood that, although portions of the above embodiments are described with reference to composite bats, the present invention also applies to other types of bats.

We claim:

1. A bat, comprising:

a handle;

a tubular barrel having a wall thickness, a density, a modulus of elasticity in a hoop direction and a modulus of elasticity in an axial direction, such that an impact with a ball produces a ball-bat interaction time, Ti, and such that a first hoop mode of vibration of the bat produced by the impact has a period selected to transfer a desired amount of released energy to the ball, the period approximately equal to 4/3Ti; and an axial bending mode of vibration produced by the impact has a period approximately equal to 4/3Ti.

2. The bat of claim 1, wherein the axial bending mode of vibration is the third axial bending mode of vibration.

3. The bat of claim 1, wherein the axial bending mode of vibration is the fourth axial bending mode of vibration.

4. The bat of claim 1, wherein the barrel is titanium.

5. The bat of claim 1, wherein the barrel is aluminum.

6. The bat of claim 1, wherein the barrel includes a matrix and fibers supported within the matrix, the fibers extending in at least one direction relative to a longitudinal axis of the bat.

7. The bat of claim 1, wherein the fibers include glass fibers.

8. The bat of claim 1, wherein the fibers include graphite fibers.

9. The bat of claim 1, wherein the matrix is epoxy resin.

10. The bat of claim 1, wherein the fibers have a modulus between 33 million psi and 120 million psi.

11. The bat of claim 7, wherein the fibers are glass fibers having a modulus between 6 million and 13 million psi.

12. The bat of claim 8, wherein the fibers are intermediate modulus graphite fibers having a modulus substantially equal to 33 million psi.

13. A bat, comprising:

a handle; and a tubular barrel having a wall thickness, a density, a modulus of elasticity in a hoop direction and a modulus of elasticity in an axial direction, such that an impact with a ball produces a ball-bat interaction time, Ti, and such that an axial bending mode of vibration of the bat produced by the impact has a period selected to transfer a desired amount of released energy to the ball, the period approximately equal to 4/3Ti.

14. The bat of claim 13, wherein the axial bending mode of vibration is the third axial bending mode of vibration.

15. The bat of claim 13, wherein the axial bending mode of vibration is the fourth axial bending mode of vibration.

* * * * *

UNITED STATES PATENT AND TRADEMARK OFFICE

CERTIFICATE OF CORRECTION

PATENT NO. : 6,322,463 B1
DATED : November 27, 2001
INVENTOR(S) : Forsythe

It is certified that error appears in the above-identified patent and that said Letters Patent is hereby corrected as shown below:

Column 10,
Line 33, "The bat of claim 1, wherein the fibers include glass…" should read -- The bat of claim 6, wherein the fibers include glass… --
Line 35, "The bat of claim 1, wherein the fibers include graphite…" should read -- The bat of claim 6, wherein the fibers include graphite… --
Line 37, "The bat of claim 1, wherein the matrix is…" should read -- The bat of claim 6, wherein the matrix is… --
Line 38, "The bat of claim 1, wherein the fibers have…" should read -- The bat of claim 6, wherein the fibers have… --

Signed and Sealed this

Tenth Day of September, 2002

*Attest:*

*Attesting Officer*

JAMES E. ROGAN
*Director of the United States Patent and Trademark Office*